United States Patent [19]

Komurasaki

[11] Patent Number: 4,862,863

[45] Date of Patent: Sep. 5, 1989

[54] ELECTRONIC IGNITION APPARATUS INCLUDING IGNITION-NOISE MAKING SIGNAL GENERATOR

[75] Inventor: Satoshi Komurasaki, Hyogo, Japan

[73] Assignee: Mitsubishi Denki Kabushiki Kaisha, Tokyo, Japan

[21] Appl. No.: 100,342

[22] Filed: Sep. 23, 1987

[30] Foreign Application Priority Data

Sep. 24, 1986 [JP] Japan ..... 61-226985

[51] Int. Cl.[4] ..... F02P 7/077

[52] U.S. Cl. ..... 123/645; 123/618

[58] Field of Search ..... 123/645, 646, 618

[56] References Cited

U.S. PATENT DOCUMENTS 3,605,713 9/1971 LeMasters et al. ..... 123/644
4,347,827 9/1982 LoCascio ..... 123/645
4,617,905 10/1986 Hill ..... 123/618

FOREIGN PATENT DOCUMENTS 59-18270 1/1984 Japan ..... 123/618
60-8444 1/1985 Japan ..... 123/618

*Primary Examiner*—Andrew M. Dolinar
*Attorney, Agent, or Firm*—Lowe, Price, LeBlanc, Becker & Shur

[57] ABSTRACT

In an electronic ignition apparatus, there are provided an ignition signal generator, an ignition circuit, an ignition-noise masking signal generator, a switching transistor and an ignition coil. The ignition signal of the ignition signal generator is supplied to the ignition circuit to produce a first ignition pulse and a second ignition pulse which is electrically isolated from the first ignition pulse. The first ignition pulse is applied to the switching transistor so as to switch the collector voltage thereof, whereby high voltage ignition pulse is produced in the ignition coil. The second ignition pulse is applied to the ignition-noise masking signal generator to produce an ignition-noise masking signal. The ignition-noise masking signal is superimposed on the ignition signal so as to mask the ignition noise at least when the high voltage ignition pulse is produced in the ignition coil.

8 Claims, 13 Drawing Sheets

FIG. 12A IGNITION PULSE

FIG. 12B DIFFERENTIAL SIGNAL

ELECTRONIC IGNITION APPARATUS INCLUDING IGNITION-NOISE MAKING SIGNAL GENERATOR

BACKGROUND OF THE INVENTION

1. Field of the Invention

The present invention relates to an electronic ignition apparatus suitable for use in an internal combustion engine to prevent erroneous ignition due to ignition noise superimposed on ignition signals.

2. Description of the Related Art

FIG. 1 is a schematic diagram of a typical conventional ignition system 11. This system 11 mainly includes an ignition signal generator 1 for generating an ignition signal in accordance with the rotation of an internal combustion engine (not shown); an ignition circuit 2 for producing, in response to the received ignition signal, an ignition pulse to energize an ignition coil 4 only for an adequate time period on the basis of driving conditions of the internal combustion engine; and a power transistor 3 triggered by the ignition pulse to energize the ignition coil 4. The above-described ignition circuit 2 and the power transistor 3 belong to an igniter circuit 10. In general, the igniter circuit 10 is fabricated practically by the use of a thick-film integrated circuit. The ignition signal 1 is incorporated in a distributor.

FIG. 2 shows operating waveforms of signals in the individual circuits of the above-mentioned ignition system 11, in which: FIG. 2A is an ignition signal generated from the ignition signal generator 1; FIG. 2B is an ignition pulse outputted from the ignition circuit 2; FIG. 2C is a coil current flowing through the ignition coil 4; and FIG. 2D is a high ignition voltage derived from the ignition coil 4.

The ignition system 11 performs the following operation. First, the ignition signal generator 1 is driven synchronously with the rotation of the internal combustion engine and generates an ignition signal in proportion to the rotation rate of the engine. The ignition signal (FIG. 2A) is fed to the ignition circuit 2, which then produces ignition pulses (FIG. 2B) under so-called "duty ratio control" in conformity with the driving conditions of the internal combustion engine. The ignition pulse has a "high" level in each of durations t1–t2, t3–t4 and t5–t6. The NPN power transistor 3 is switched on and off repeatedly in response to these ignition pulses so as to be turned on at the "high" level of each ignition pulse, and also to be turned off at the "low" level thereof. Then, coil current shown in FIG. 2C flows in the ignition coil 4 by the switching operation of the power transistor 3, and an ignition voltage represented in FIG. 2D is applied to a spark plug (not shown) at the coil current interruption. Thus, the high ignition voltage is outputted at each of time instants t2, t4 and t6.

In the ignition system 11 with the above circuit arrangement, there may arise a problem of ignition noise if the ignition signal generator 1 and the igniter circuit 10 are not positioned in the distributor integrally as in a specific case where the igniter circuit 10 is mounted to a vehicle body separately from the distributor.

This ignition noise problem will now be described below with reference to FIG. 3. There are shown a harness 15 for connecting the primary winding 4A of the ignition coil 4 to the collector of the power transistor 3 in the igniter circuit 10 via a first signal terminal 10A of the igniter circuit 10, and harnesses 16 and 17 for connecting the ignition signal generator 1 to the ignition circuit 2. FIG. 3 is a typical conventional circuit corresponding to the ignition circuit 2 of FIG. 1. The circuit arrangement of this conventional ignition circuit 2 will be described in detail later.

As mentioned above, the harnesses 15 through 17 have a function of interconnecting the ignition signal generator 1, the ignition coil 4 and the igniter circuit 10, and practically some connectors (not shown in detail) are employed therein with the harnesses 15–17 bundled in wiring. As a result, the harnesses 15–17 are physically adjacent to one another to cause electrical interference. For achieving exact ignition at the spark plug, therefore, a shielded wire is used particularly for each of the harnesses 16 and 17 connected between the ignition signal generator 1 and the igniter circuit 10 to suppress electromagnetic induction of ignition noise from the harness 15 which is a primary signal line of the ignition coil 4. Similarly, a shielded wire is used also for the harness 15 to directly suppress ignition noise.

Practically, however, there still exist some non-shielded portions due to the connectors (not shown in detail) provided in the harnesses 15–17. Moreover it is actually impossible to shield the bodies of the connectors and the wire ends of the harnesses inserted therein. Consequently, in a structure where the igniter circuit 10 is incorporated separately from the ignition signal generator 1, resultant ignition noises are superimposed on the ignition signals fed to the igniter circuit 10. The longer the non-shielded portions of the harnesses 15–17 become, the more the ignition noises increase. The shielding effect is dependent also on the joint performance of the shielded wire used in each connector.

Now a further detailed description will be given below on the ignition noise caused by the ignition and erroneous ignition resulting therefrom. In the internal circuit arrangement of the ignition circuit 2 shown in FIG. 3, there are included a voltage comparator 21, a first reference power source 22 for applying a first reference voltage to one input terminal 21A of the voltage comparator 21, a second reference power source 23 connected to a reference voltage terminal 1A of the ignition signal generator 1 and serving to apply a second reference voltage thereto, and a diode 24 connected between another input terminal 21B of the voltage comparator 21 and the ground. The diode 24 is so connected that a forward current flows therein when the input voltage for the other input terminal 21B of the voltage comparator 21 becomes a negative voltage. The ignition signal output terminal 1B of the ignition signal generator 1 and the other input terminal 21B of the voltage comparator 21 are connected to each other. The second reference voltage applied from the second reference power source 23 is fed to the voltage comparator 21 via a signal path established from the aforementioned reference terminal 2A of ignition circuit 2, harness 17, reference voltage terminal 1A of ignition signal generator 1, ignition signal generator 1, output terminal 1B of ignition signal generator 1, input terminal 2B of ignition circuit 2, and the other input terminal 21B of voltage comparator 21. Then the second reference voltage is compared with the first reference voltage obtained from the first reference power source 22, so that a basic, or low voltage ignition pulse is produced. The basic ignition pulse thus obtained is fed as a base signal to the power transistor 3 via a duty ratio controller (not shown in detail) which performs the duty ratio control in accordance with the driving conditions of the internal combustion engine.

FIG. 4 shows the detailed waveforms of signals obtained in the individual circuits of FIG. 3 at the time of generating the ignition voltage (FIG. 2D) by interruption of the coil current (FIG. 2C) flowing in the ignition coil 4. FIG. 4A is a base voltage of the power transistor 3; FIG. 4B is an operation mode of the power transistor 3; FIG. 4C is a collector voltage of the power transistor 3; and FIG. 4D is an input voltage to the ignition signal input terminal 2B of the ignition circuit 2. This waveform chart roughly represents a phenomenon on a scale of 10 microseconds. The reference voltage terminal 1A of the ignition signal generator 1 is supplied with the second reference voltage from the second reference power source 23, and the generated ignition signal (FIG. 2A) is superimposed on such second reference voltage. The ignition signal of FIG. 2A is fed to the other input terminal 21B of the voltage comparator 21 via the ignition signal input terminal 2B of the ignition circuit 2 and then is compared with the first reference voltage applied to one input terminal 21A, whereby the comparison signal is converted into the aforementioned basic ignition pulse. Subsequently, the ignition pulse is controlled by the duty ratio controller and then is inputted to the base of the power transistor 3 to switch the transistor 3, thereby energizing the ignition coil 4. More specifically, in a state of normal ignition, the base voltage of the power transistor 3 is inverted from "high" level to "low" level at an instant t10 in FIG. 4A, so that the power transistor 3 is switched off at the subsequent instant t11 as shown in FIG. 4B (the time period between t10 and t11 corresponds to a delay in the operation of the power transistor 3). Consequently, the collector voltage of the power transistor 3 is turned to "high" level during the time period of t11–t13 to produce a pulsed voltage. The ignition voltage generated at the secondary winding 4B of the ignition coil 4 is induced by such pulsed voltage after an instant t13 also at the primary winding 4A of the ignition coil 4 serving as a transformer, and the collector voltage thus induced appears with a half sine wave as shown in FIG. 4C. The phenomenon that the induced voltage of such waveform based on the ignition voltage appears at the primary winding 4A of the ignition coil 4, occurs when a discharge gap (not shown) of the spark plug connected to the secondary winding 4B of the ignition coil 4 has an infinite length. Assuming now that the harnesses 15 and 16 are positioned with a sufficient space kept therebetween, the input voltage to the ignition signal input terminal 2B of the ignition circuit 2 is entirely free from interference induction of the collector voltage of the power transistor 3 as represented by a solid line in FIG. 4D, so that the result waveform is not adversely influenced with induction of even the collector voltage pulse generated during the time period of t11–t13 during which the voltage variation rate is high.

To the contrary, in case the harnesses 15 and 16 are positioned to be directly adjacent to each other, a collector voltage pulse (t11–t13) of the power transistor 3 appears at the ignition signal input terminal 2B of the ignition circuit 2 due to induction from one harness 15 to another harness 16. Since such collector voltage pulse has a high voltage variation rate, it causes a greater inductive action than the collector voltage waveform succeeding to the instant t13, hence causing harmful ignition noise in the ignition circuit 2 (as represented by a broken line in FIG. 4D). The ignition noise increases due to induction as the physical space between the harnesses 15 and 16 becomes shorter or the mutual proximity thereof is kept over a longer distance. In addition to the above, such ignition noise is dependent also on the joint performance of each harness within the connectors.

When the ignition noise thus induced exceeds the operating voltage "Vr" of the voltage comparator 21 at the time of generation of the ignition voltage, the voltage comparator 21 produces an extra pulse (represented by a broken line in FIG. 4A) at the instant t12. As a result, such extra pulse unnecessarily turns on again the power transistor 3 which has been once turned off at the instant t11 (as represented by a broken line in FIG. 4B), whereby the ignition coil 4 is unnecessarily energized. The time period between t11 and t12 corresponds to the response delay of the circuits other than the power transistor 3. Since the collector voltage pulse (FIG. 4C) generated in the time period t11–t13 has a short duration of 10 microseconds or so, the ignition noise (represented by a broken line in FIG. 4D) appearing at the ignition signal input terminal 2B of the ignition circuit 2 is also as short as 10 microseconds or so. Therefore the extra on-time of the power transistor 3 starting with the instant t12 comes to be about 10 microseconds, so that the former off-state is resumed at an instant t15 after the lapse of several 10 microseconds from the instant t12. However, even at the instant t15 (corresponding to the normal off-instant of the transistor 3), a pulsed voltage similar to the one at the instant t11 (normal instant) appears in the collector voltage of the transistor 3, whereby the phenomenon of such pulsed voltage generation is successively repeated during the time period t11–t13. Since the repetition characteristic is different depending on the degree of electrical interference between the harnesses 15 and 16 as well as on the characteristics of the ignition system 11, the repetition cycle and frequency are not fixed. The erroneous ignition caused from the interference between the harnesses 15 and 16 is likely to occur more readily with regard to the harness 16 on one side than to the harness 17 on the other side, because the latter 17 is more proximate to the second reference power source 23 and has a lower impedance as compared with that of the harness 16. The operating voltage Vr is basically determined by the difference between the first and second reference voltages of the first and second reference power sources 22 and 23. Since the operating voltage Vr is controlled by the source voltages and the ignition signal period, there arises a problem of ignition noise. Accordingly, the operating voltage Vr is so set as to become high at the time of generation of the ignition voltage. However, in the electronic ignition circuit of FIG. 3 where the operating voltage Vr is at most several volts, there exists a drawback that, depending on the joint performance of the harnesses, the ignition noise reaches almost double the value shown in FIG. 4D and consequently satisfactory antinoise characteristic is not attainable.

In order to solve the above problem, there is conceived another conventional ignition system shown in FIG. 5. In this circuit, a resistor 25 is connected between the positive terminal of a second reference power source 23 and the reference voltage terminal 2A of an ignition circuit 2, a feedback circuit 31 containing a series connection of a resistor 32 and a capacitor 33 is connected between the reference voltage terminal 2A of the ignition circuit 2 and a pulse generator 36. The pulse generator 36 is provided for producing ignition pulses in response to the comparison signal of the voltage comparator 21 so as to optimally drive the power transistor 3. Precisely speaking, the pulse generator 36 outputs a first ignition pulse to drive the power transistor 3 and a second ignition pulse having an in-phase relation thereto to the above feedback circuit 31. Such individual generation of the ignition pulses as mentioned is based on the fact that the first ignition pulse for driving the power transistor 3 is influenced by the operation of the transistor 3 and its waveform and voltage are thereby varied. Since the feedback needs to be executed without any harmful influence from such variations, the first ignition pulse for driving the transistor 3 is not applied to the feedback circuit 31.

Merely the above circuit configuration alone is the difference in comparison with the first-mentioned ignition system of FIG. 3, and the remaining circuits are exactly the same as those included in the system of FIG. 3. Therefore, the explanation is omitted here.

FIG. 6 shows the operating waveforms of signals obtained in the individual circuits of FIG. 5, in which: FIG. 6A is a base voltage of the power transistor 3; FIG. 6B is its operation mode; FIG. 6C is its collector voltage; FIG. 6D is a feedback signal; and FIG. 6E is an input voltage to the ignition signal input terminal 2B of the ignition circuit 2. The base voltage of the power transistor 3 is inverted from "high" level to "low" level at an instant t20 and subsequently, is turned off from its on-state at an instant t21 after the lapse of a predetermined time period (t20–t21). Simultaneously with inversion of the base voltage of the power transistor 3 from "high" level to "low" level, the pulse circuit 36 produces its output by inverting the feedback signal (FIG. 6D) from "high" level to "low" level. The feedback circuit 31 produces a differential voltage $V_{FB}$ in response to the feedback signal from the circuit 36 and superimposes the feedbacked differential voltage $V_{FB}$ on the output of the second reference power source 23, whereby the second reference voltage obtained from the second reference power source 23 is rendered lower by a value corresponding to the differential voltage $V_{FB}$. Consequently, the voltage at the ignition signal input terminal 2B of the ignition circuit 2 also becomes lower in accordance therewith since the low component of the differential voltage $V_{FB}$ serves as a negative component to the second reference voltage. Succeeding to the instant t20, the differential voltage $V_{FB}$ from the feedback circuit 31 gradually approximates to the high component in conformity with its differentiation characteristic. A pulsatory collector voltage of the power transistor 3 appears at the instant t21, which will become an ignition noise in the input voltage to the ignition signal input terminal 2B of the ignition circuit 2. The differential voltage $V_{FB}$ from the feedback circuit 31 has a sufficiently low value even during the time period between the instants t21 and t22 in which the ignition noise is generated. As a result, the peak value of the ignition noise never exceeds the operating voltage Vr of the voltage comparator 21, and therefore an erroneous inversion of the power transistor 3 to its on-state by the ignition noise is not caused unlike in the aforementioned first example of the prior art at the instant t12 (FIG. 4B).

Thus, in the second conventional ignition system of FIG. 5, the ignition noise can be substantially masked by the feedback voltage from the feedback circuit 31 of a simple configuration. However, the ignition pulse derived from the pulse circuit 36 is inputted to the feedback circuit 31 also at its rising portion (not shown in FIG. 6) from "low" level to "high" level and then is superimposed on the second reference voltage of the second reference power source 23. This phenomenon occurs during energization of the ignition coil 4 and exerts harmful influence on the energizing characteristic (i.e. duty ratio characteristic) of the ignition coil 4. Consequently, in the second conventional ignition system of FIG. 5, there still exists another drawback that execution of the feedback for merely preventing the ignition noise only is not sufficient.

In other words, according to the last-mentioned conventional ignition system illustrated in FIG. 5, another problem is raised, although it is practically possible to solve the aforementioned ignition noise problem that is induced by the high voltage ignition pulse voltage on the wiring of harnesses 15–17. Another disadvantage is such that the duty ratio characteristic of the ignition coil is deteriorated.

Now such deterioration of the duty ratio characteristic will be described below with reference to the graphic representation of FIG. 7, in which the duty ratio is plotted along the ordinate and the rotation along the abscissa.

In FIG. 7 showing the duty ratio characteristic of the ignition coil 4, a solid line represents basic characteristic (i.e., desired duty ratio characteristic obtained without the feedback circuit 31). In case the feedback circuit 31 is present, the amount of feedback increases with the duty ratio having a greater value as represented by a broken line, so that the ignition coil 4 is energized in surplus correspondingly and it brings about a surplus current consumption in the coil 4 or thermal break down thereof.

As is obvious from the above description, the second conventional ignition system shown in FIG. 5 has advantageous effects to prevent the erroneous ignition if the ignition noise superimposed on the ignition signal is relatively small. However, a great amount of feedback is required for maintaining a normal operation if any great ignition noise appears. In the latter case where unnecessary energization of the ignition coil is executed, extra current consumption and heat generation are caused in the ignition coil to eventually raise a problem of its thermal break down.

The present invention has been accomplished in an attempt to solve these conventional drawbacks, and an object to provide an improved electronic ignition apparatus which is adapted for use in an internal combustion engine and is capable of completely preventing erroneous ignition against any great ignition noise while performing proper energization of an ignition coil in conformity with desired duty ratio characteristic.

SUMMARY OF THE INVENTION

The above-described and other objects of the present invention are realized by employing an electronic ignition apparatus (100;200;300) comprising:

an ignition signal generator (1) for generating an ignition signal in response to rotation of an internal combustion engine;

an igniter circuit (50) for generating an ignition pulse in response to the ignition signal supplied from the ignition signal generator (1);

an ignition coil (4) having a primary winding (4A) and a secondary winding (4B) magnetically coupled thereto, for producing a high voltage ignition pulse at the secondary winding (4B) in response to the ignition pulse applied from the igniter circuit (50) to the primary winding (4A), the high voltage ignition pulse at the secondary winding (4B) being applied to a spark plug; and harness members (15;16;17) for interconnecting the ignition signal generator (1), igniter circuit (50), and ignition coil (4), the above-described igniter circuit (50) including at least;

an ignition circuit (20) for generating the ignition pulse in response to the ignition signal of the ignition signal generator (1); and, an ignition-noise masking signal generator (40) for generating an ignition-noise masking signal by receiving the ignition pulse of the ignition circuit (20) and for superimposing the ignition-noise masking signal on the ignition signal in the ignition circuit (20) at least when the high voltage ignition pulse is produced in the ignition coil (4), so as to mask the ignition noise induced in the harness members by the high voltage ignition pulse of the ignition coil (4).

This ignition circuit (20) includes:

a comparator (21) having a first input terminal (21A), a second input terminal (21B) connected to the ignition-noise masking signal generator (40), and an output terminal;

a first reference power supply (22) connected between the first input terminal (21A) and a ground, for applying a first reference voltage to the first input terminal (21A);

a first diode (24), the cathode of which is connected the second input terminal (21B) of the comparator (21), and the anode of which is connected to the ground;

a pulse generator (36) for generating, as the ignition pulse, a first ignition pulse and a second ignition pulse electrically isolated from the first ignition pulse by receiving a comparison signal from the output terminal of the comparator (21), the first ignition pulse being applied to the primary winding (4A) of the ignition coil (4) and the second ignition pulse being applied to the ignition-noise masking signal generator (40); and, a second reference power supply (23) for applying a second reference voltage to the ignition signal generator (1).

According to an electronic ignition apparatus, the above-described igniter circuit (50) further comprises:

a first signal terminal (10A);

a switching transistor (3), the base of which receives the first ignition pulse from the pulse generator 36 to switch a collector voltage thereof, the switched collector voltage being applied to the primary winding (4A) of the ignition coil (4) via the first signal terminal (10A);

a second signal terminal (2A) connected between the second reference power supply (23) and a reference voltage terminal (1A) of the pulse signal generator (1); and, a third signal terminal (2B) connected between the second input terminal (21B) of the comparator (21) and an ignition signal output terminal (2B) of the pulse signal generator (1).

Then, these harness members include:

a first harness (15) for connecting the collector of the switching transistor (3) to the primary winding (4A) of the ignition coil (4) via the first signal terminal (10A);

a second harness (17) for connecting the second reference power supply (23) of the ignition circuit (20) to the reference voltage terminal (1A) of the pulse signal generator (1) via the second signal terminal (2A); and, a third harness (16) for connecting the second input terminal (21B) of the comparator (21) to the ignition signal output terminal (1B) of the ignition signal generator (1) via the third signal terminal (2B).

BRIEF DESCRIPTION OF THE DRAWINGS

For a better understanding of these and other objects of the present invention, reference is made to the following description of the invention to be read in conjunction with the following drawings, in which.

DETAILED DESCRIPTION OF THE PREFERRED EMBODIMENTS

BASIC IDEA

Before describing various types of electronic ignition apparatus according to the invention, a basic idea of the electronic ignition apparatus will now be summarized.

Figure 8:
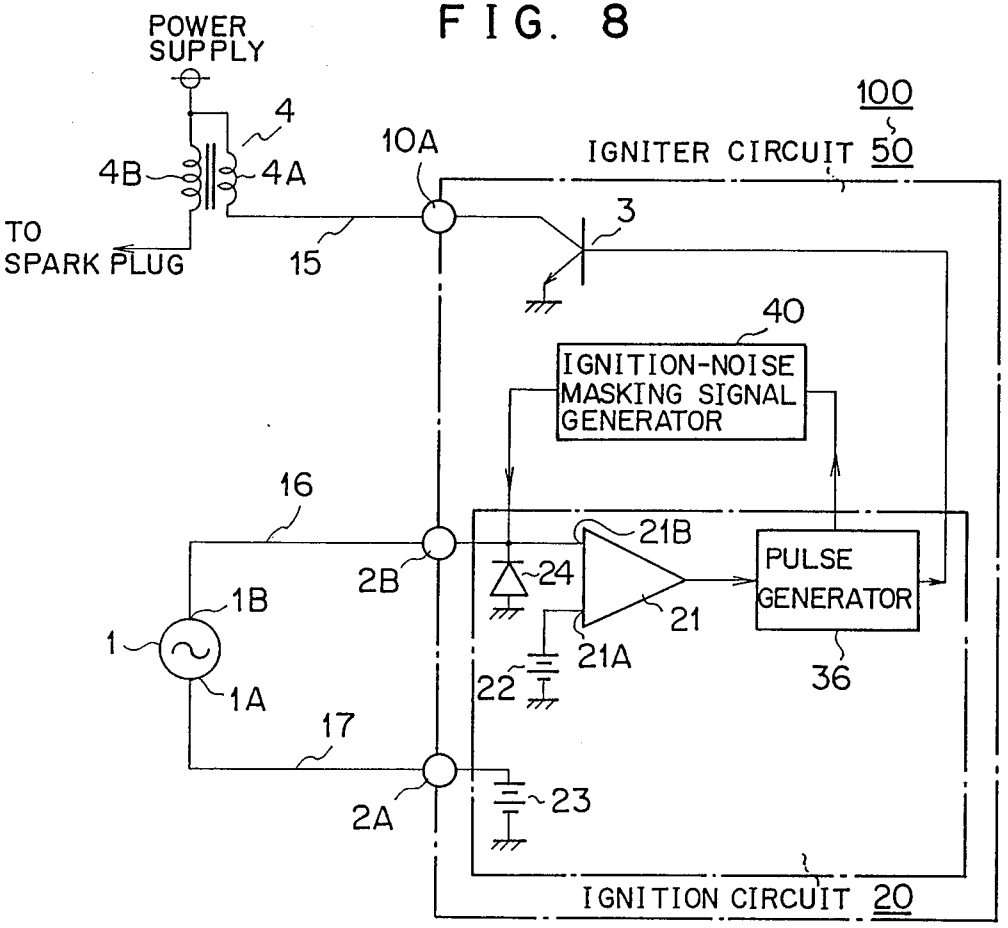
FIG. 8 schematically shows a block diagram of the basic idea of an electronic ignition system according to the invention.

In FIG. 8, there is shown a basic circuit diagram of an electronic ignition apparatus 100 according to the invention.

Figure 1:
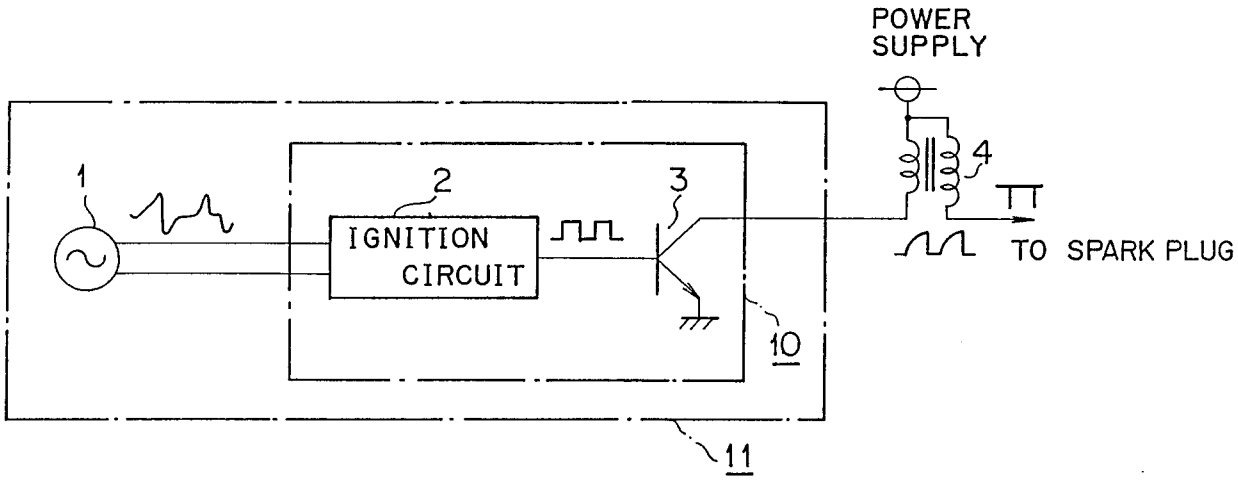
FIG. 1 PRIOR ART
FIG. 1 is a schematic block diagram illustrating a conventional electronic ignition system.
Figures 2, 2A, 2B, 2C, 2D:
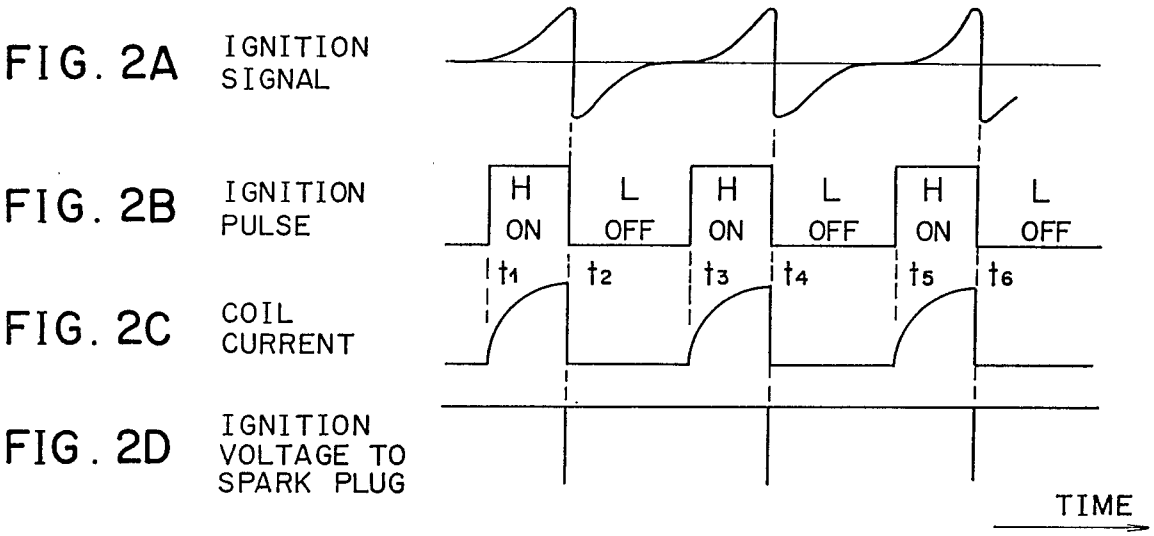
FIG. 2 PRIOR ART
FIG. 2 shows waveforms of the circuit shown in FIG. 1.
Figure 3:
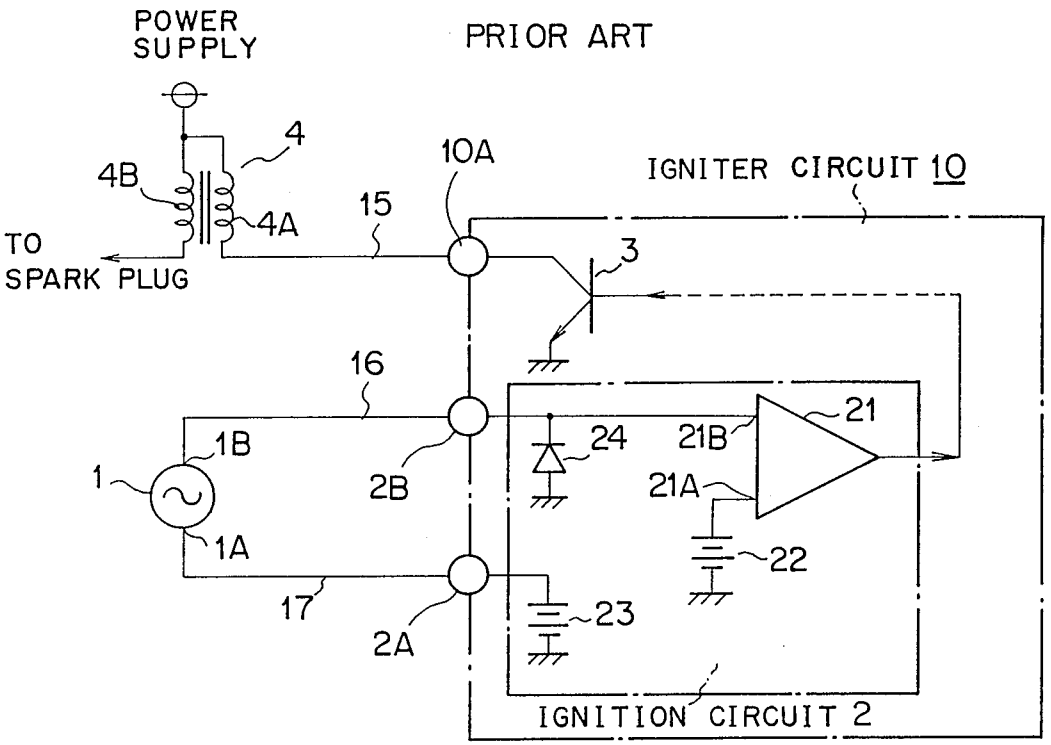
FIG. 3 PRIOR ART
FIG. 3 is a schematic block diagram of another conventional electronic ignition system.
Figures 4, 4A, 4B, 4C, 4D:
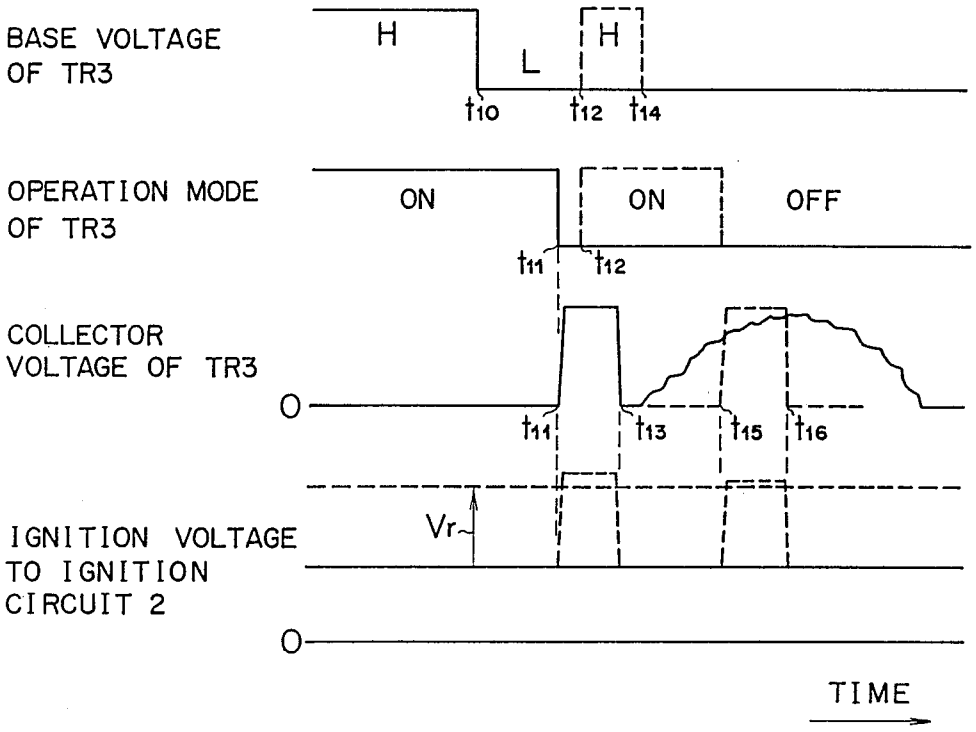
FIG. 4 PRIOR ART
FIG. 4 illustrates waveforms of the circuit shown in FIG. 3.
Figure 5:
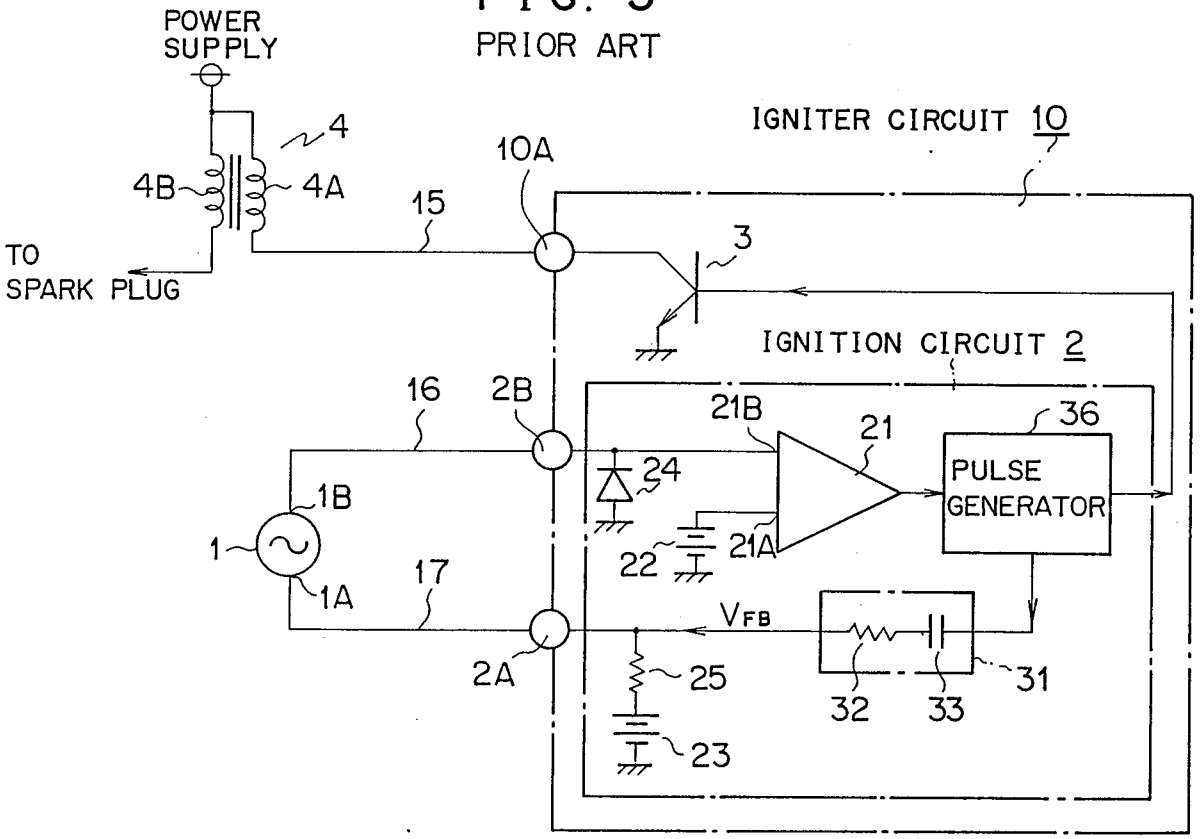
FIG. 5 PRIOR ART
FIG. 5 is a schematic block diagram of still another conventional electronic ignition system.
Figures 6, 6A, 6B, 6C, 6D, 6E:
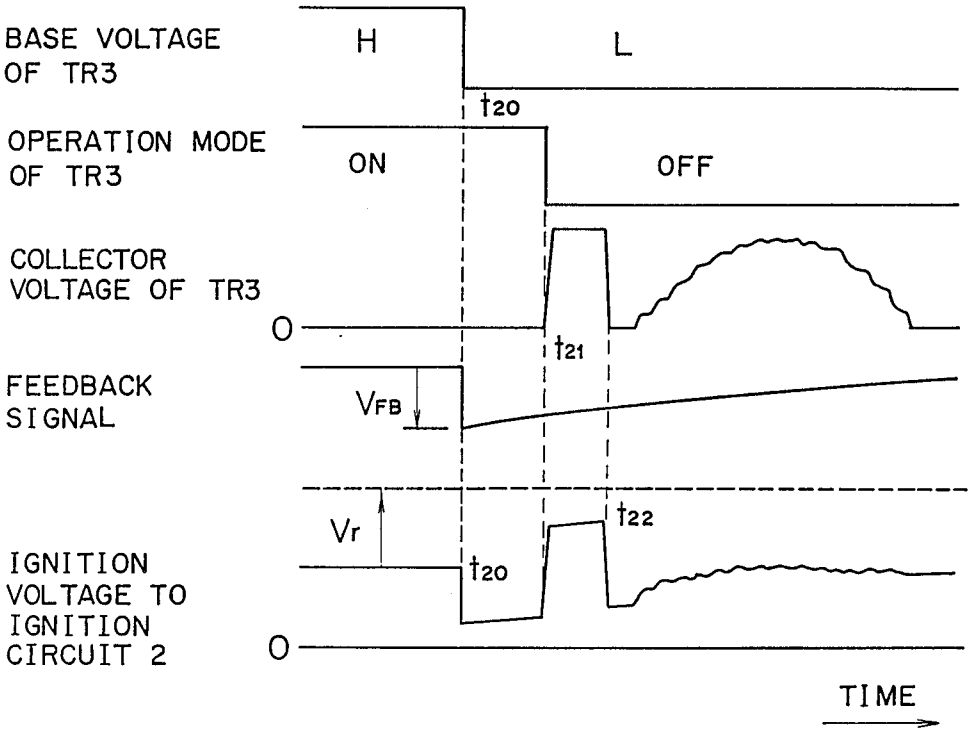
FIG. 6 PRIOR ART
FIG. 6 represents waveforms of the circuit shown in FIG. 5.

The like or same circuit elements as those used in the aforementioned ignition system of FIG. 5 are denoted by the same reference numerals in the following drawings, and a detailed explanation thereof is omitted here.

In the preferred embodiment shown in FIG. 8 and the subsequent drawings, it is assumed that first to third harnesses 15–17 are positioned in the physical proximity to one another under the condition that mutual electromagnetic interference and induction of high voltage ignition noises are caused through connectors (not shown in detail) provided in the first to third harnesses 15–17.

Referring back to the basic circuit of FIG. 8, there is similarly provided a pulse generator 36 for generating first and second ignition pulses in response to the output comparison signal derived from a voltage comparator 21 of an ignition circuit 20.

The second ignition pulse obtained from the pulse generator 36 is supplied to an ignition-noise masking signal generator 40, which in turn generates a signal for masking an ignition noise, so-called "an ignition-noise masking signal". This masking signal is supplied to a junction between an ignition signal input terminal 2B of an igniter circuit 50 and a cathode of a diode 24. The junction is also connected to the other input terminal 21B of the comparator 21, while a first reference voltage source, or power supply 22 is connected to one input terminal 21A of the comparator 21. A positive terminal of a second reference voltage source, or power supply 23 is connected directly to an ignition signal generator 1 via a reference voltage terminal 2A of the ignition circuit 20 and the second harness 17. Since the remaining circuit configuration is the same as that in the aforementioned ignition system of FIG. 5, a further explanation thereof is omitted.

The electronic ignition system 100 of the above circuit arrangement performs the following operation.

For the purpose of masking any harmful influence of the ignition noise induced at the time of generation of a high ignition voltage from the ignition coil 4, an ignition-noise masking signal generator 40 is incorporated in the igniter circuit 50 so as to supply the ignition-noise masking signal to the ignition signal input terminal 2B of the igniter circuit 50 only during generation of the ignition voltage, whereby the harmful influence of the ignition noise resulting from the ignition voltage can be eliminated to eventually avoid the erroneous ignition operation of the ignition system 100. Since this masking signal is supplied to the comparator 2 only during generation of the ignition voltage and not during energization of the ignition coil 4, the above-described conventional problem of generation of any unwanted heat can be avoided in the ignition coil 4.

FIRST MASKING MODE OF IGNITER CIRCUIT

Figure 9:
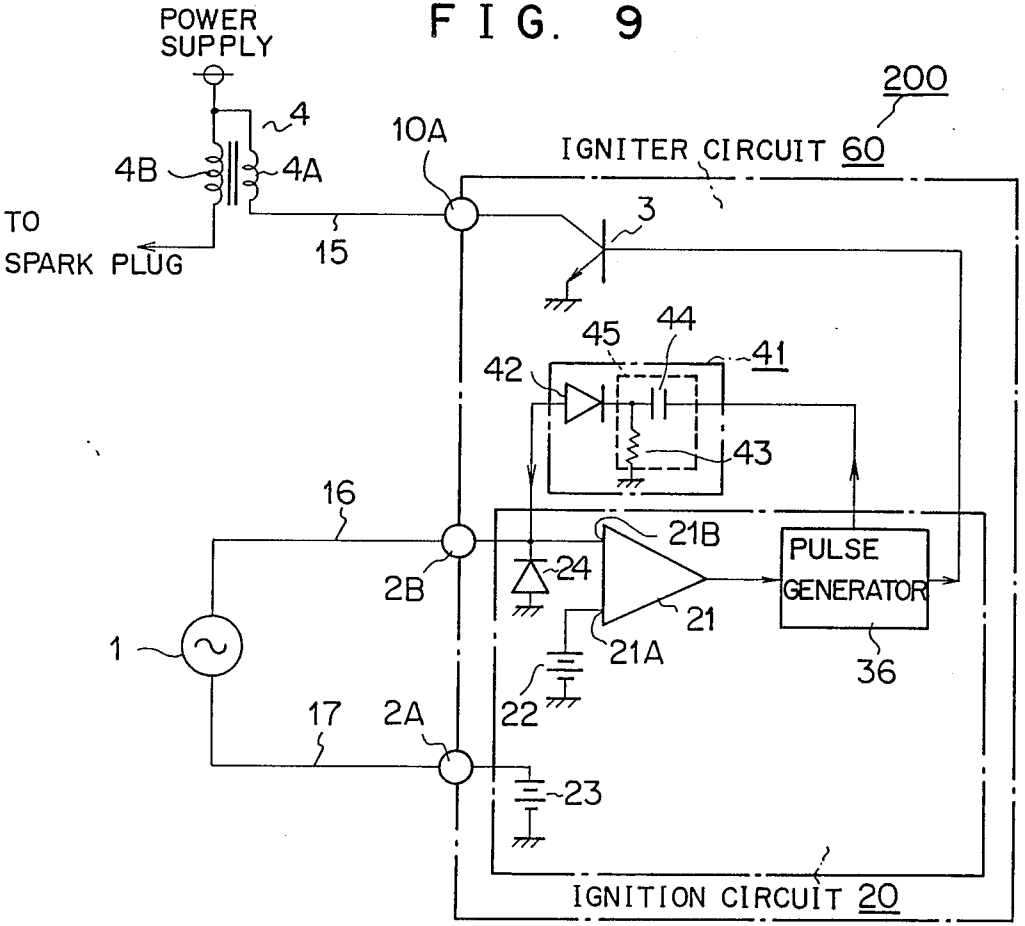
FIG. 9 is a circuit diagram of an electronic ignition system according to a first preferred embodiment employing a feedback circuit.

Referring now to FIG. 9, an electronic ignition system 200 according to a first preferred embodiment will be described.

In brief, this electronic ignition system 200 employs, as the ignition-noise masking signal generator 40, a feedback circuit 41 composed of a differential circuit 45 and a positive-pulse-component clipping diode 42. The differential circuit 45 is arranged by a resistor 43 and a capacitor 44.

Figure 7:
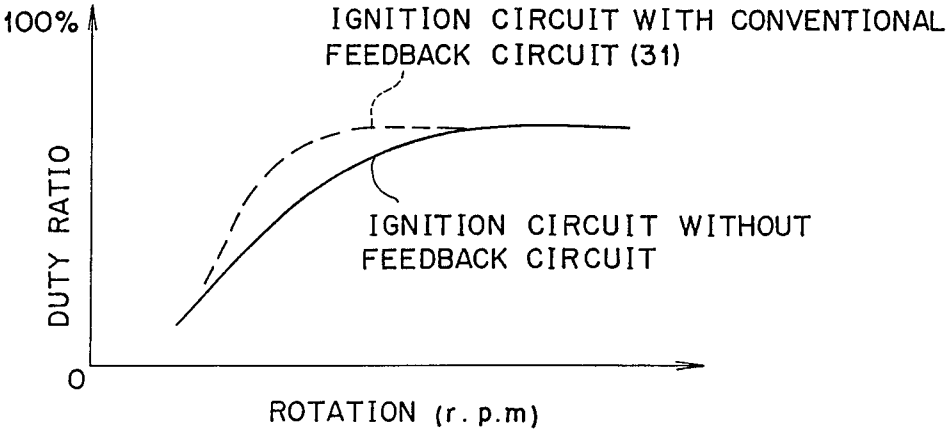
FIG. 7 is a graphic representation of duty ratio.
Figure 10:
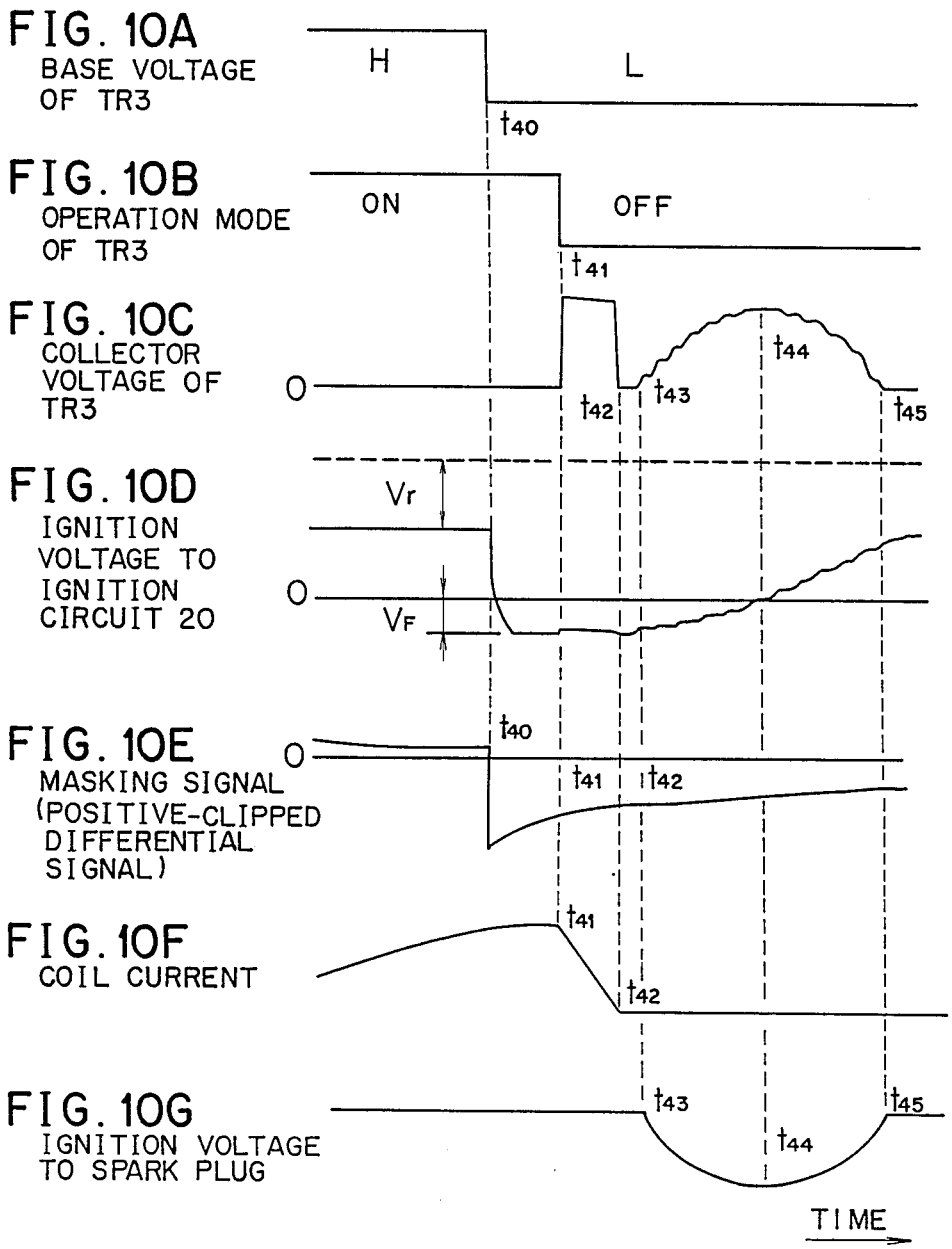
FIG. 10 shows waveforms of the circuit shown in FIG. 9.

FIG. 10 shows the operating waveforms of various signals obtained in the circuits of the first preferred embodiment. FIG. 10A shows a base voltage of a power transistor 3. FIG. 10B represents its operation mode. FIG. 10C illustrates its collector voltage, FIG. 10D indicates an ignition voltage at an ignition signal input terminal 2B of an ignition circuit 2, FIG. 10E represents a masking signal, the positive component of which has been clipped, FIG. 10F shows an ignition coil current and FIG. 10G illustrates a high ignition voltage to a spark plug. The voltage comparator 21 produces an ignition pulse having the basic characteristic represented by a solid line in FIG. 7, and such basic ignition pulse is then inputted to the pulse generator 36 so as to be converted into an ignition pulse adapted for providing the ignition coil 4 with optimal current characteristic (energizing current). The first ignition pulse thus converted is used for switching the power transistor 3 while the second ignition pulse is supplied to the feedback circuit 41 as will be described in detail later. The ignition coil 4 is energized through the switching action (substantially on-mode duration) of the power transistor 3 in cooperation with another power supply and a high ignition voltage is induced at each interruption of such coil energizing current in the ignition coil 4 (see FIG. 10G). Meanwhile, the second ignition pulse from the pulse generator 36 is inputted to the feedback circuit 41. It is to be noted that the first ignition pulse signal fed to the base of the power transistor 3 is not supplied directly to this feedback circuit 41. That is, the second ignition pulse supplied to the feedback circuit 41 is electrically isolated from the first ignition pulse signal fed to the base of the transistor 3. This is because the waveform of the first ignition pulse (i.e., rising and falling edges, or its voltage) are varied by switching operations of the power transistor 3, which in turn gives adverse influences to the feedback circuit 41.

DIFFERENTIAL CIRCUIT

Referring to the differential circuit 45 shown in FIG. 11, a description will be made below on the basic characteristic of the feedback circuit 41. The second ignition pulse obtained from the pulse generator 36 is supplied to the input terminal of the capacitor 44, and the voltage across the resistor 43 is outputted as a feedback signal, i.e., a differential signal.

Figure 11:
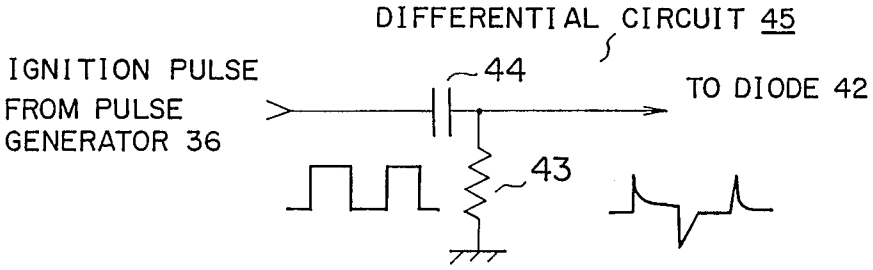
FIG. 11 is a differential circuit of FIG. 9.
Figure 12:
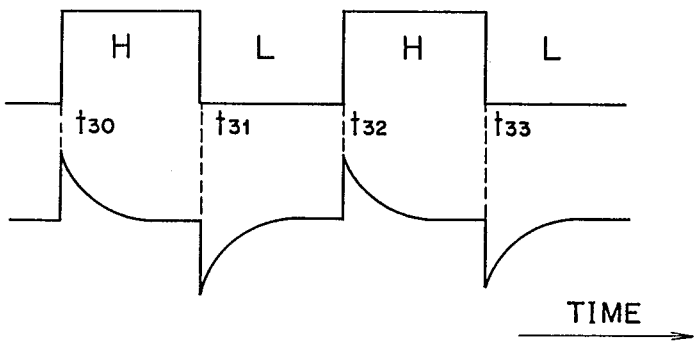
FIG. 12 illustrates waveforms of ignition pulses and differential signal of the differential circuit illustrated in FIG. 11.

FIG. 12 shows the operating waveforms of signals in the differential circuit of FIG. 11, in which FIG. 12A is an input signal thereto or the second ignition pulse obtained from the pulse generator 36, and FIG. 12B is the differential signal which is an output signal from the differential circuit 45. The second ignition pulse from the pulse generator 36 corresponds to a "high" level or a "low" level correspondingly to an on-state or an off-state of the power transistor 3. In FIG. 12, instants t30 and t32 correspond to the commencement of energizing the ignition coil 4, whereas instants t31 and t32 correspond to the ending thereof, respectively. Since the capacitor 44 is charged and discharged by such second ignition pulse via the resistor 43, the output signal is shaped into a differential waveform. The differential signal thus obtained is fed via the positive-component clipping diode 42 to the ignition signal input terminal 28 of the ignition circuit 2, so that the resultant input signal to the terminal 2B is clipped to a predetermined negative voltage ($V_F$) at an instant t40 as shown in FIGS. 10D and 10E. This operation is performed in the condition that a forward current is caused to flow in a diode 24 of the ignition circuit 2 by the differential signal of FIG. 12B and is clipped to a forward voltage (negative voltage) $V_F$. The forward current flowing through the diode 24 of the ignition circuit 20 is gradually attenuated with the lapse of time in the sequence of instants t40–t41–t42 conforming to the differentiation characteristic of the differential feedback signal and simultaneously the forward voltage is also attenuated that is, will reach a zero volt (see FIG. 10E). As is obvious from FIG. 10E, a sufficient forward current is still flowing in the diode 24 even at the instant t41 where the ignition noise is generated, so that the anode voltage of the diode 24 is substantially equal to the voltage at the instant t40. It follows therefore that a completely clipped state is maintained even at the instant t41 by properly selecting the capacitance of the capacitor 44. That is, the clipped signal voltage can be rendered equal to the potential at the instant t40. As a result, the resultant ignition signal inputted to the voltage comparator 21 at the instant t41 is maintained at a sufficiently low potential without causing any erroneous comparison detection, so that no erroneous ignition operation is effected by the ignition noise. This resultant ignition signal corresponds to the signal of FIG. 10D obtained by superimposing the positive-component clipped differential signal, or the feedback signal (i.e., masking signal) of the feedback circuit 41 on the ignition signal produced from the ignition signal generator 1.

As described in detail hereinabove, the feature resides in the capability that prevents the erroneous ignition as well as deterioration of the duty ratio of the ignition system 200, which may otherwise be caused due to the ignition noise, by cooperation of the positive-component, clipped diode 48 and the differential circuit 45 of the feedback circuit 41, as well as diode 24 of the ignition circuit 20 connected to the other input terminal 24 of the comparator 21.

REDUCTION IN ENERGIZING CURRENT TO IGNITION COIL

Since a diode 42 is incorporated in the feedback circuit 41, a reverse voltage is applied to the diode 42 when the differential signal waveform has a positive component, thereby electrically separating the feedback circuit 41 from the ignition circuit 2. Consequently, the positive feedback signal component is clipped to eventually accomplished complete elimination of the undesired increase in the energizing current to the ignition coil.

That is to say, the positive differential signal component is clipped by the diode 42 to obtain a masking signal, i.e., feedback signal which also has a function of improving the energizing characteristic of the ignition coil 4.

According to the preferred embodiment, as mentioned above, merely the positive signal component out of the differential signal from the differential circuit 45 is clipped by the diode 42, and the resultant masking signal is superimposed on the ignition signal from the ignition signal generator 1 so that the average value of the masking signal or feedback signal superimposed on the ignition pulse signal supplied to the other input terminal 21B of the comparator 21 becomes lower than the average value of the masking signal including both the positive and negative signal components. Consequently, it becomes possible to attain the effect of improving the duty ratio characteristic particularly in a range of low rotation rates.

AC/DC EFFECTS BY DIFFERENTIAL CIRCUIT

Since the feedback circuit 41 is so formed as to produce as the feedback signal the differential signal by utilizing the characteristic of the capacitor 44 for passing the AC component therethrough, the feedback circuit 41 functions in an AC manner to the ignition circuit 2 to eliminate the harmful influence of the ignition noise.

Figure 13:
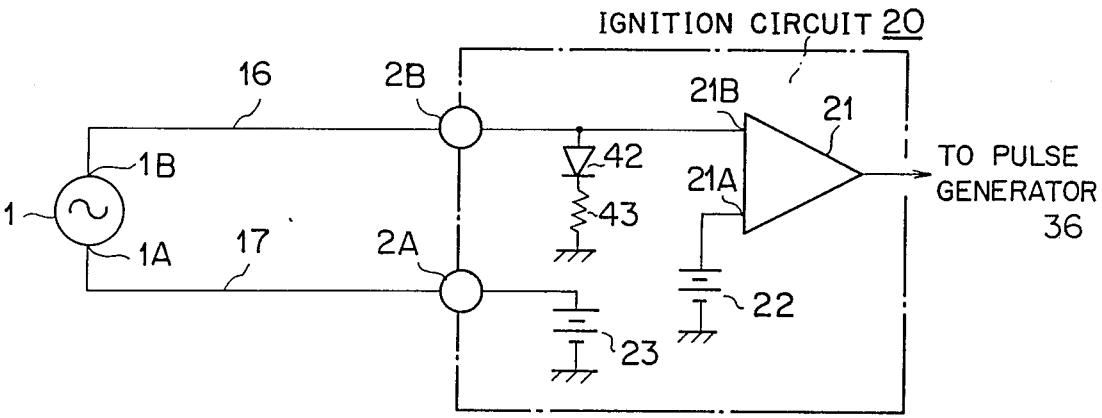
FIG. 13 is a schematic circuit diagram to explain the DC effect of the feedback circuit shown in FIG. 9.

Now a description will be given on the DC effect of the feedback circuit 41 to the ignition circuit 2. FIG. 13 is a partial circuit diagram of the igniting system shown in FIG. 9, including merely the diode 42 and the resistor 43 of the feedback circuit 41 functioning in a DC manner to the ignition circuit 2. The second reference voltage outputted from the second reference power source 23 is applied to the voltage comparator 21 via the second harness 17, the ignition signal generator 1 and the third harness 16. Since a series circuit of the diode 42 and the resistor 43 is connected between the other input 21B of the voltage comparator 21 and the ground, the second reference (DC) voltage from the second reference power source 23 is divided by the sum of the respective internal resistance of the second harness 17, the ignition signal generator 1 and the third harness 16, and also by the sum of the internal resistances of the diode 42 and the resistor 43. Consequently, the DC voltage applied to the voltage comparator 21 is reduced to be lower than the value obtained in the absence of the diode 42 and the resistor 43. As previously described, the voltage comparator 21 is driven at the basic operational voltage "Vr" equal to the difference voltage between the first and second reference voltages of the first and second reference power sources 22 and 23, so that the difference between the input potentials to the voltage comparator 21 becomes greater by a value corresponding to the reduction due to the division of the second reference voltage of the second reference power source 23 by a combination of the diode 42 and the resistor 43. Accordingly, the detection voltage "Vr" is increased as a result. This implies that, as compared with the conventional example in which the voltage required for operating the voltage comparator 21 is higher than "Vr", the actual detection voltage in this embodiment needs to be the sum of "Vr" and the voltage value caused by the diode 42 and the resistor 43. As a result, a greater ignition signal output is required from the ignition signal generator 1.

To enable the ignition signal generator 1 to produce such a high ignition voltage, it is necessary to increase the rotation rate of the internal-combustion engine due to the principle of operation. Then the necessity of a higher rotation rate of the internal combustion engine eventually brings about a problem of harmful influence on the characteristics of the ignition system particularly in important lower rotation rates. However, such a harmful influence is not so merely significant in the preferred embodiments where the resistance value of the resistor 43 can be set on the order of megohms or more. In fact, considering that the ignition signal generator 1 has an internal resistance of 1 to 2 kilohms or so, such harmful influence is so small as to be negligible without a significant difference in respect of the lower rotation rate of the internal combustion engine in practical use.

In other words, even if the feedback circuit 41 employed in the preferred embodiment is additionally connected to the conventional ignition circuit, it is possible to substantially prevent deterioration of the ignition system characteristics in a range of lower rotation rates by properly selecting the resistance value of the differential resistor 43 with respect to the internal resistance of the ignition signal generator 1.

The first masking mode of the igniter circuit 60 will now be summarized.

First, the second ignition pulse supplied from the pulse generator 36 is converted into a differential signal by the differential circuit 45 of the feedback circuit 41. The differential signal (precisely speaking, the positive component clipped differential signal) has a function of preventing superimposition of ignition noise on the ignition signal to the comparator 21, and such function is realized by a combination of the diode 24 in the ignition circuit 20 and the differential circuit 45. That is to say, the ignition voltage applied to the ignition circuit 20 is clipped at the negative potential ($V_F$) at least during a time period from instant t40 to t42. Meanwhile in the conventional ignition system, the ignition voltage applied to the ignition circuit 2 is not clipped at the negative potential. As a result, even if any ignition noise is superimposed on the ignition voltage, the transistor 3 is never turned on again by such ignition noise, since the ignition voltage is clipped to the negative potential side by a sufficient forward current flowing in the diode 24.

Furthermore, since only the positive component of the differential signal is cut by the diode 42, it is possible to avoid increase of the energizing current flowing through the primary winding 4A of the ignition coil 4.

Thus, according to the present embodiment, the above described two features can be simply realized by means of additional connection of the simple feedback circuit 41 to the ignition circuit 20.

SECOND MASKING MODE OF IGNITER CIRCUIT

A second masking mode of an igniter circuit 80 employed in an electronic ignition system 300 according to a second preferred embodiment will now be described with reference to FIG. 14.

Figure 14:
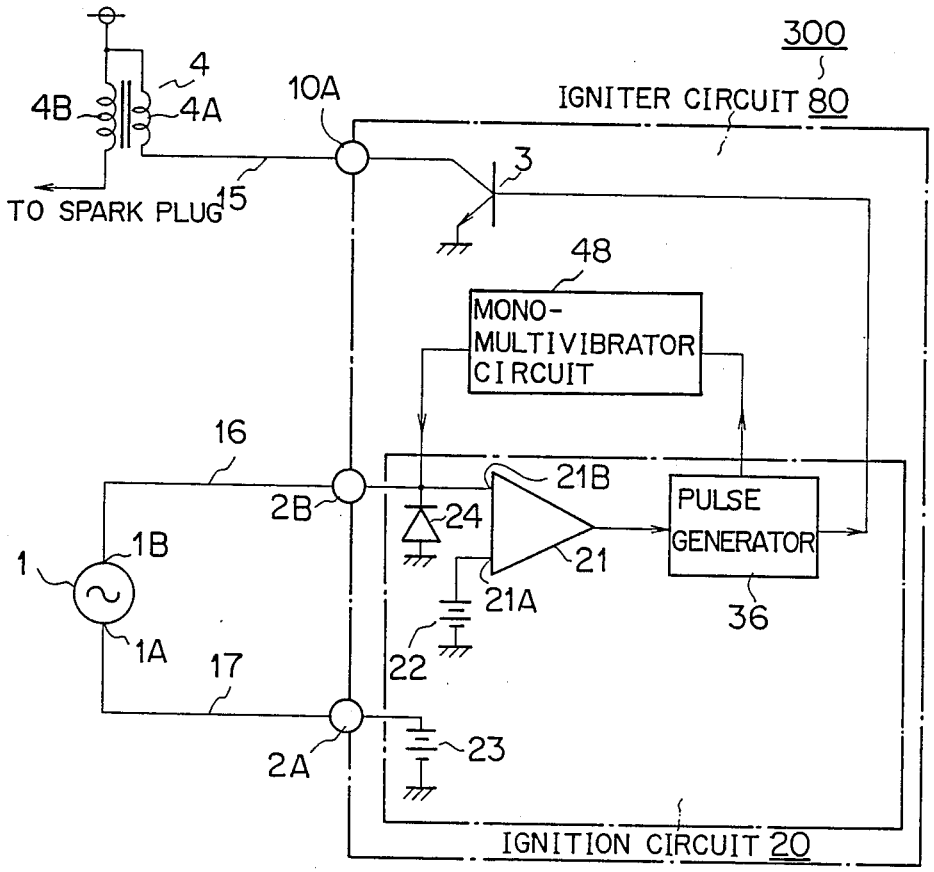
FIG. 14 is a schematic circuit diagram of an electronic ignition system according to a second preferred embodiment.

Since the entire circuit arrangement of FIG. 14 is substantially identical with that of FIG. 9, a description will be made of only a different circuit.

A mono-multivibrator circuit 48 for generating a masking signal is connected to receive the second ignition pulse from the pulse generator 36. The output of the mono-multivibrator circuit 48 is connected to the junction of the ignition signal input terminal 2B, the cathode of the diode 24 in the ignition circuit 20 and the other input terminal 21B of the comparator 21.

A negative rectangular pulse is produced from the mono-multivibrator circuit 48 in response to the falling edge from a "high" level to a "low" level of the second ignition pulse obtained from the pulse generator 36. The duration of the negative level component of such rectangular pulse is so preset that, as same as in the first embodiment shown in FIG. 10, the negative level of the rectangular pulse is maintained at least during a time period t41–t42 over which ignition noise is produced. Such duration preset is executed by properly selecting the time constant of the mono-multivibrator circuit 48, which is well known in the art.

By virtue of the circuit configuration mentioned, the ignition noise can be completely clipped as in the first embodiment, and simultaneously another advantage is achieved to prevent increase of the energizing current flowing through to the ignition coil 4.

According to the principle of the present invention, as is obvious from the above description, the circuit arrangement is not limited to the aforementioned embodiments, and a variety of modifications may be conceived. For example, a zero-cross detector may be employed in place of the feedback circuit of FIG. 9, or the mono-multivibrator circuit of FIG. 14. The essential point is that any circuit may be employed if it can satisfy the requirement of detecting the falling edge of the second ignition pulse and generating a masking signal of a predetermined duration to satisfactorily clip the ignition noise.

EXPERIMENTAL RESULTS

The following are the results of various experiments conducted in relation to the igniter circuit 60 of the first embodiment shown in FIG. 9.

An ignition coil of type E-065 was employed, and a supply voltage of 14 volts was selected. The resistor 43 in the differential circuit 45 of the feedback circuit 41 was selectively set at 3 $\mu\Omega$, and the capacitor 44 therein at 0.047 $\mu$F, respectively. The diode 42 was an equivalent of TOSHIBA 1S1555, and a distributor for three cylinders was used with its rotation rate ranging from approximately 300 to 3,500 r.p.m. The duty ratio attained under such conditions was about 14 to 80%.

Figure 15:
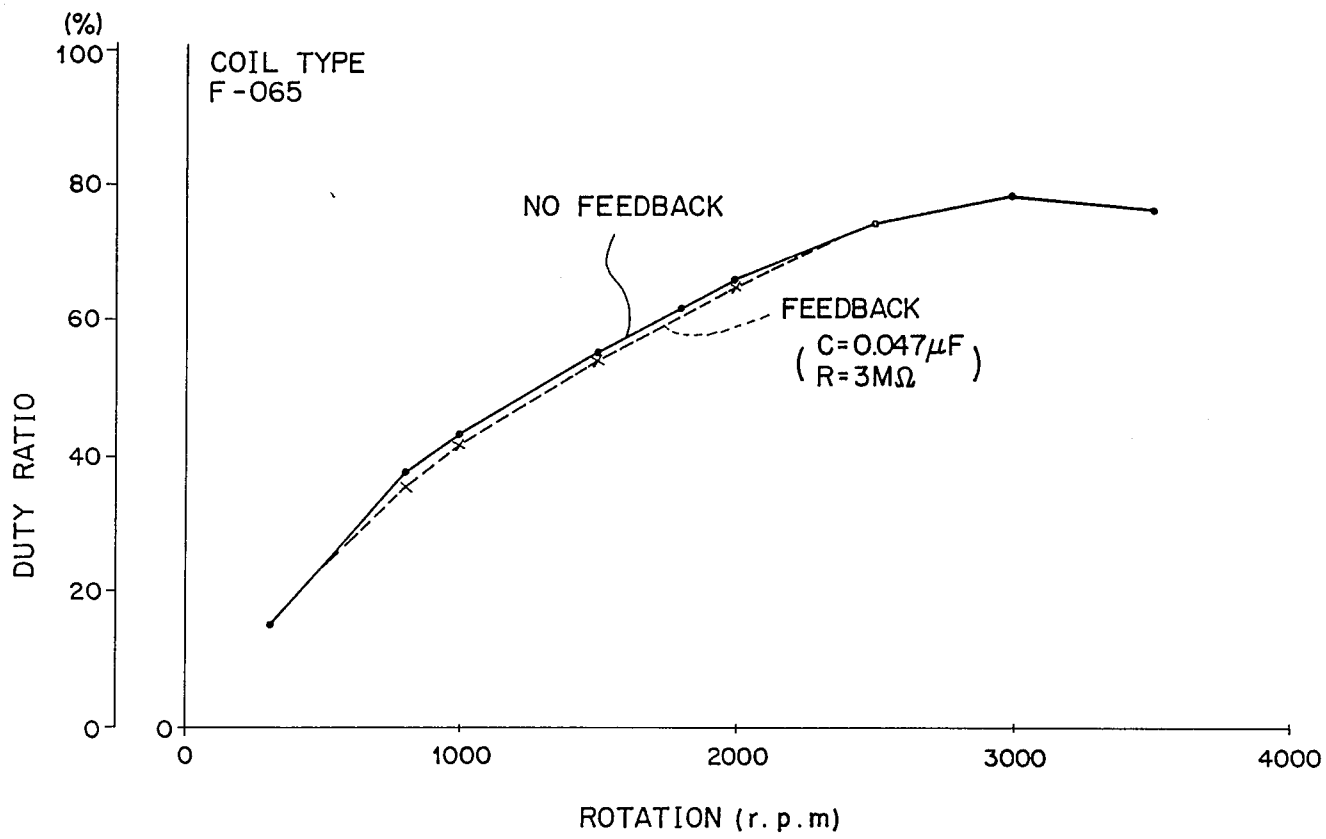
FIG. 15 is a graphic representation of the relationship between the duty ratio and the rotation of the ignition system according to the invention.

The results of the above measurements are graphically represented in FIG. 15. For a better understanding of the effects of the embodiment, the measurement results obtained relative to the conventional ignition system without such feedback circuit 41 are also plotted.

As will be apparent from the graphic representation, it is proved that, in a wide range of low and high rotation rates, the duty ratio attained with employment of the feedback circuit 41 remains substantially unchanged in comparison with the ratio in the conventional ignition system without such feedback circuit.

Thus, as described in detail hereinabove, the present invention contains the remarkably advantageous effects summarized below.

An ignition-noise masking signal generator of an extremely simple configuration is additionally provided for the circuit of the conventional ignition system, and an ignition-noise masking signal obtained therefrom is supplied to the specific harness side, i.e., the third harness 16 side connecting the ignition signal generator 1 to the ignition circuit 20 and positioned in the proximity of the comparator 21, not of the reference power source 23, hence achieving the aforementioned two particular features.

Practically, ignition noise is induced in both harnesses 16 and 17. However, even if such a masking signal is fed back to the second harness 17 connected to the reference power source 23, the above-described effects are not expectable due to the relationship of internal impedance of the two harnesses 16 and 17. In contrast therewith, according to the present invention where this masking signal is fed back to the third harness 16 connected to the comparator 21, ignition noise can be satisfactorily masked directly even in a sufficiently low voltage range.

As mentioned hereinabove, in the present invention where a feedback signal is applied to the ignition signal input terminal of the igniter circuit at the time of generation of the high ignition voltage, i.e., ignition noise, any harmful influence of the ignition noise superimposed on the ignition signal simultaneously with generation of the ignition voltage can be canceled by the feedback signal to consequently prevent erroneous ignition. Since the application of such feedback signal is executed only at the time of generation of the ignition voltage, or ignition noise, energization of the ignition coil can be perfomed exactly in conformity with the basic ignition characteristics. In other words, there is achieved another advantage that the total length relative to the non-shielded portion of each input-output signal harness can be increased.

What is claimed is:

1. An electronic ignition apparatus comprising:

means for generating an ignition signal in response to rotation of an internal combustion engine;

igniter circuit means for generating an ignition pulse in response to the ignition signal supplied from the ignition signal generating means;

ignition coil means having a primary winding and secondary winding magnetically coupled thereto, for producing a high voltage ignition pulse at the secondary winding in response to the ignition pulse applied from the igniter circuit means to the primary winding, said high voltage ignition pulse at the secondary winding being applied to a spark plug; and harness means for interconnecting the ignition signal generating means, igniter circuit means, and ignition coil means, said igniter circuit means including:

an ignition circuit for generating the ignition pulse in response to the ignition signal of the ignition signal generating means, and an ignition-noise masking signal generator for generating an ignition-noise masking signal by receiving the ignition pulse of the ignition circuit and for superimposing the same on the ignition signal in the ignition circuit at least when the high voltage ignition pulse is produced in the ignition coil means, so as to mask the ignition noise induced in the harness means by the high voltage ignition pulse of the ignition coil means, said ignition circuit including:

a comparator having a first input terminal, a second input terminal connected to the ignition noise masking signal generator, and an output terminal;

a first reference power supply connected between the first input terminal and a ground, for applying a first reference voltage to the first input terminal;

a first diode, the cathode of which is connected to the second input terminal of the comparator, and the anode of which is connected to the ground;

a pulse generator for generating, as the ignition pulse, a first ignition pulse and a second ignition pulse electrically isolated from the first ignition pulse by receiving a comparison signal from the output terminal of the comparator, said first ignition pulse being applied to the primary winding of the ignition coil means and said second ignition pulse being applied to said ignition-noise masking signal generator; and a second reference power supply for applying a second reference voltage to the ignition signal generating means.

2. An electronic ignition apparatus as claimed in claim 1, wherein the igniter circuit further comprises:

a first signal terminal;

a switching transistor, the base of which receives the first ignition pulse from the pulse generator to switch a collector voltage thereof, the switched collector voltage being applied to the primary winding of the ignition coil means via the first signal terminal;

a second signal terminal connected between the second reference power supply and a reference voltage terminal of the pulse signal generating means; and, a third signal terminal connected between the second input terminal of the comparator and an ignition signal output terminal of the pulse signal generating means.

3. An electronic ignition apparatus as claimed in claim 2, wherein the harness means includes:

a first harness for connecting the collector of the switching transistor to the primary winding of the ignition coil means via the first signal terminal;

a second harness for connecting the second reference power supply of the ignition circuit to the reference voltage terminal of the pulse signal generating means via the second signal terminal; and, a third harness for connecting the second input terminal of the comparator to the ignition signal output terminal of the ignition signal generating means via the third signal terminal.

4. An electronic ignition apparatus as claimed in claim 1 wherein the ignition-noise masking signal generator includes:

a differential circuit for producing a differential signal from the first ignition pulse of the pulse generator; and, a second diode for clipping a positive signal component of the differential signal so as to apply only a negative signal component of the differential signal to the second input terminal of the comparator.

5. An electronic ignition apparatus as claimed in claim 4, wherein the differential circuit is constructed of:

a resistor having a resistance of 3 MΩ; and, a capacitor having a capacitance of 0.047 μF.

6. An electronic ignition apparatus as claimed in claim 1, wherein the ignition-noise masking signal generator is constructed of a mono-multivibrator circuit for producing a negative rectangular pulse signal from the second ignition pulse of the pulse generator.

7. An electronic ignition apparatus as claimed in claim 6, wherein the mono-multivibrator circuit produces the negative rectangular pulse signal in response to only a falling edge of the second ignition pulse.

8. An electronic ignition apparatus as claimed in claim 1, wherein the second input terminal of the comparator receives an operational voltage (Vr) which is produced by subtracting the first reference voltage from the second reference voltage, superimposed on a negative signal component of the ignition-noise masking signal, whereby a potential of the ignition signal applied to the second input terminal of the comparator becomes below zero volt at least when the high voltage ignition pulse is produced in the ignition coil means.

* * * * *